US010442094B1

(12) United States Patent
Weir

(10) Patent No.: US 10,442,094 B1
(45) Date of Patent: Oct. 15, 2019

(54) MULTIPURPOSE MACHETE WITH SPUR KNIFE AND REMOVABLE STORAGE HANDLE ASSEMBLY

(71) Applicant: Robert F. Weir, Nevada City, CA (US)

(72) Inventor: Robert F. Weir, Nevada City, CA (US)

( * ) Notice: Subject to any disclaimer, the term of this patent is extended or adjusted under 35 U.S.C. 154(b) by 303 days.

(21) Appl. No.: 13/999,783

(22) Filed: Mar. 21, 2014

(51) Int. Cl.
*B26B 11/00* (2006.01)

(52) U.S. Cl.
CPC ..... *B26B 11/006* (2013.01)

(58) Field of Classification Search
CPC ..... B26B 11/00–11/006; B26B 3/00; B26B 1/10; B25F 1/00; B25B 23/16
USPC ..... D22/118
See application file for complete search history.

(56) References Cited

U.S. PATENT DOCUMENTS

D67,685 S * 6/1925 Drew ..... 30/165
2,315,898 A * 4/1943 Krilow ..... B26B 9/02 30/345
2,766,471 A * 10/1956 McKenzie ..... B26B 5/00 15/105
3,760,438 A * 9/1973 White ..... B25F 1/02 30/143
4,622,707 A * 11/1986 Finn ..... B26B 3/06 294/2
4,773,769 A * 9/1988 Church ..... F16C 29/02 384/40
4,778,415 A * 10/1988 Knotts ..... B63H 20/10 248/640
4,821,356 A * 4/1989 Finn ..... F41C 27/18 30/342
5,615,445 A * 4/1997 Kelsay ..... B25G 1/10 15/143.1
2010/0101095 A1* 4/2010 Prasetya ..... B26B 11/006 30/123
2015/0226429 A1* 8/2015 Holland ..... F23Q 1/06 431/274

FOREIGN PATENT DOCUMENTS

DE 202011003483 U1 * 6/2011
GB 2171628 A * 9/1986

* cited by examiner

*Primary Examiner* — Stephen Choi

(57) ABSTRACT

The present invention is a multipurpose machete assembly comprising of a no tool removable handle/scales, a ferrocium rod or bottle with cap holder or mount and a multipurpose blade. The blade has a spur knife for precision work, a gut hook, a spear point/digging point, a recessed area for holding dirt, a cooking pan, a special toothed high efficiency saw, a hook/gaff, a forward lanyard hole, a hammer/pommel/knob, a flat area for scrapping, a long strait or flat section for using as a draw knife, and holes through blade for processing cordage.

7 Claims, 12 Drawing Sheets

MULTIPURPOSE MACHETE WITH SPUR KNIFE AND REMOVABLE STORAGE HANDLE ASSEMBLY

FIELD OF INVENTION

The present invention relates to the field of large knives or "machetes" and more particularly relates to a multipurpose machete, which is designed to increase the utility and function of a machete.

BACKGROUND OF THE INVENTION

A problem or difficulty with current art machetes is that because the blade is so long and unwieldy, it is difficult to do more precision knife work, like piercing, whittling, carving and food preparation. The point of the blade is too far from the handle to make precision knife work possible. The point area of a machete is also prone to be dulled quickly with other cutting and digging tasks. Current art has the disadvantage of only being able of performing the tasks of chopping and cutting, because it does not have a spur knife, and the handle is not removable nor does it have a storage area inside.

SUMMARY OF THE INVENTION

The present invention is an assembly designed to increase the function and utility of a machete. The utility and function are increased by adding unique features to the blade which allow this multipurpose machete to be able to do these cutting operations, and more: sawing, chopping, precision knife work (Ref. whittling, carving and food preparation), log handling, fish and game processing, digging, scrapping, draw-knifing, spearing, cordage processing, cooking, scrapping and hammering. Further, this multipurpose machete has a unique removable handle that requires no tools to remove it, and has a storage area inside for holding a uniquely stowed fire starter/ferrocium rod; or a sealed container. Other necessary items for outdoor use can also be stowed here. Because the multipurpose machete's handle is integrated into the blade, in a unique way, the handle still remains at almost full strength, and while still having removable handle/scales for storage. Further, the multipurpose machete has a saw feature on it's spine, and the specially shaped saw tooth is unique to machetes and is a higher efficiency saw tooth design.

This invention adds a "spur knife" to the blade near the handle, which makes precision knife work possible; while still retaining the machetes capacity for heavier chopping and cutting. The spur knife is positioned out of the way of these actions; thus, ensuring it stays protected and sharp. Further, this uniquely designed machete blade is capable of performing many more tasks and has a unique handle capable of storing items without loss of strength.

In view of the foregoing disadvantages inherent in the known types of machetes, this invention provides a machete capable of performing many more tasks efficiently. As such, the present invention's purpose is to provide the new and improved multipurpose machete assembly to be easy to use and perform many tasks well, including, but not limited to: sawing, chopping, precision knife work, log handling, fish and game processing, digging, scrapping, draw-knifing, spearing, cooking, and hammering. Further this invention has the capability to store necessary outdoor items such as a fire starter ferrocium rod or container inside the handle/scales.

To accomplish these objectives, the assembly comprises a uniquely designed blade, a right and a left handle/scale with specially shaped clasping pins installed in each, a threaded stud with a clasp pin, which then is installed into the blades integral handle. Then, when a hammer/pommel/knob, with a corresponding female thread, is screwed down to capture said handle/scale, and force engagement of said clasp pins into the blades integral handle, this action then secures the handle/scales to the blade and the contents stowed within the handle/scales.

The more important features of the invention have thus been outlined in order so that the more detailed description that follows may be better understood and in order that the present contribution to the art may be better appreciated. Additional features of the invention will be described hereafter and will form the subject matter of the claims that follow.

Many objects in this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited to in the application to the details of construction and the arrangements of the components set forth in the description or illustrated in the drawings. The invention is capable of other embodiments and of being practiced and carried out in various ways. Also it is understood that the phraseology and terminology employed herein are for the purpose of description and should not be regarded as limiting As such, those skilled in the art will appreciate that the conception, upon which this disclosure is based, may readily be utilized as a basis for designing other structures, methods and systems for carrying out several purposes of the present invention. It is important, therefore, that the claims be regarded as including such equivalent constructions insofar as they do not depart from the spirit and scope of the present invention.

In accordance with an embodiment, a machete, includes a handle and a blade which is connected to the handle, the blade has a proximal part which is disposed adjacent to the handle, and a spine. A spur knife is disposed at the proximal part of the blade opposite the spine, the spur knife protrudes away from the handle and tapers to a sharp point, and the spur knife has a cutting edge.

In accordance with another embodiment, the handle includes a removable left handle scale and a removable right handle scale, the removable left handle scale and the removable right handle scale form a storage area therebetween. The removable left handle scale and the removable right handle scale handle scale each include a plurality of clasp pins. The blade includes an integral handle part, the integral handle part includes a plurality of chamfered holes which are shaped and dimensioned to engage the plurality of clasp pins.

In accordance with another embodiment, the removable left handle scale and the removable right handle scale each include a tapered part. The handle includes a knob which has a tapered female counter bore which is shaped and dimensioned to engage the tapered parts of the removable left handle scale and the removable right handle scale.

In accordance with another embodiment, a threaded stud is removably connected to the integral handle part of the blade. The knob is shaped and dimensioned to threadably engage the threaded stud.

In accordance with another embodiment, the blade includes an integral handle part which includes an aperture having a first end and an opposite second end. A first mount pin is disposed at the first end of the aperture, and a second mount pin is disposed at the second end of the aperture. A jack screw is connected to a container. The jack screw is connectable to the first mount pin, and the container is connectable to the second mount pin.

In accordance with another embodiment, the blade includes an integral handle part which includes an aperture having a first end and an opposite second end. A ferrocium rod is shaped and dimensioned to fit in the aperture.

In accordance with another embodiment, a saw blade is disposed on the spine of the blade, the saw blade includes a plurality of spaced-apart teeth. Each tooth has a cutting edge which is angled with respect to a cutting direction. Each tooth includes a chip relief groove. A plurality of kerf depth limiters are disposed between the teeth.

In accordance with another embodiment, the blade includes a pan and a pour spout which communicates with the pan.

Accordingly, a primary object of the present invention is to provide a large knife or machete with the capability of a small knife, by integrating a spur knife near the handle.

Another object of the present invention is increase the efficiency of the saw on the spine of this multipurpose machete. This is accomplished by using a specially designed chisel saw tooth blade.

Another object of the present invention is to provide an easily accessible storage room inside the handle of the multipurpose machete.

Another object of the present invention is to store a ferrocium rod or container inside the blades integral handle.

Another object of the present invention is to provide a ¼" tool driver integrated into the hammer/pommel of the multipurpose machete.

Another object of the present invention is to provide a pocket or pan and pour spout that is formed into the blade. This pan reduces the weight of the multipurpose machete while creating an area to hold dirt when using the MPM as a shovel or as an emergency pan to cook small pieces of food or to boil water.

Another object of the present invention is to provide a hook that can be used to pull in logs and branches when processing firewood. This hook, when sharpened on the inside, can also be used to harvest fruit that is out of reach.

Other further objects of the present invention will become clear from careful reading of the included drawing figures, the claims and detailed descriptions of the invention.

DETAILED DESCRIPTION OF THE PREFERRED EMBODIMENT

With reference now to the drawings, the preferred embodiment of the multipurpose machete assembly is herein described. It should be noted that the articles "a", "an", and "the", as used in this specification, include plural referents unless the content dictates otherwise.

Figure 1:
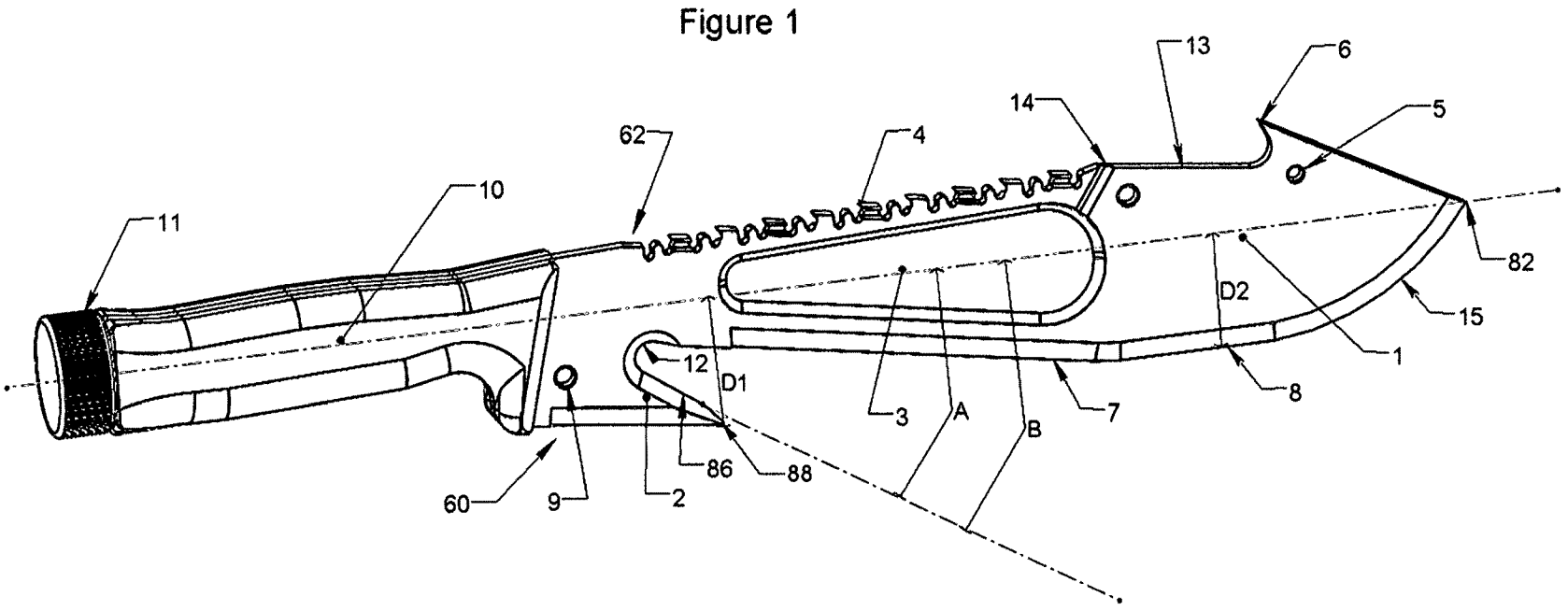
FIG. 1 is a right trimetric view of the multipurpose machete assembly of the present invention.

With reference to FIG. 1, the preferred Embodiment 1, multipurpose machete with spur knife and removable storage handle assembly consists of these components: a Multipurpose machete blade 1, a spur knife 2, a pan pocket 3, a chisel tooth saw 4, a cordage processing holes 5, log handler/high hook harvester 6, draw knife area 7, Scraping flat 8, forward lanyard hole, 9, removable handle/scale 10, hammer/pommel/knob 11, gut hook/ferrocerium rod scraper 12, baton flat 13, pan pour spout 14, chopping edge 15. Blade 1 includes a proximal part 60 which is disposed adjacent to removable handle 10. Blade 1 further includes a spine 62.

Figure 2:
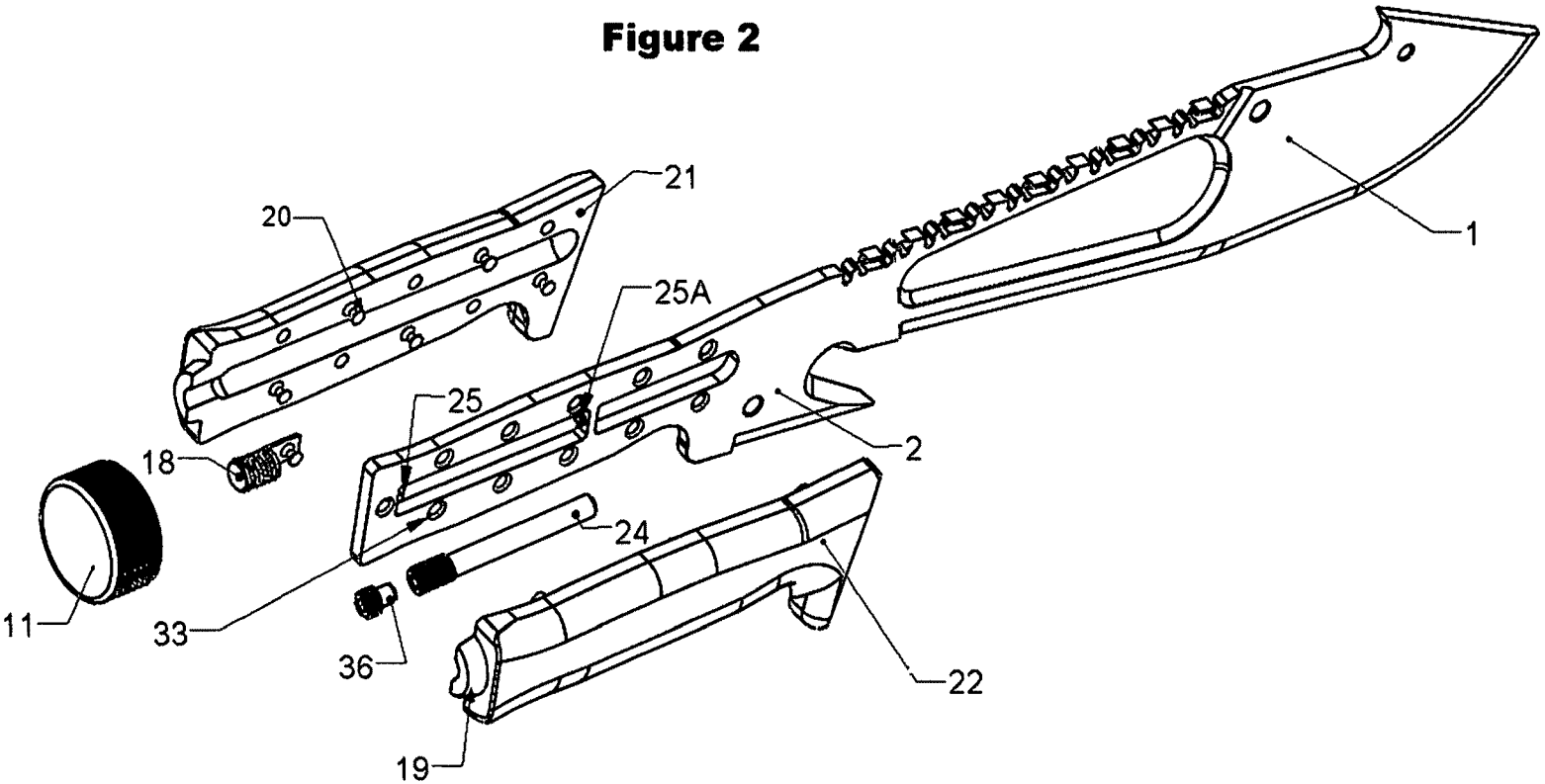
FIG. 2 is a trimetric exploded view of the multipurpose machete assembly of the present invention.

The multipurpose machete is shown in an exploded view in FIG. 2 this view depicts that when the hammer/pommel/knob 11, is unscrewed from threaded stud with clasp pin 18, then tension is released from integral taper on handle/scales 19, and thus allows clasp pins 2U, installed in left handle/scale 21 and right handle/scale 22 to be able to release and be removed through the chamfered holes 33 in the multipurpose machete's blade 1, the spur knife 2, is integrated into said blade 1. When jack screw 36 is screwed in, ferrocium rod/container 24, becomes loose and thus can be removed from integrated mount pins 25 and 25A, located in blade handle 1. Note, throughout out many of the embodiments, the ferrocium rod and container with cap are depicted as the same size and shape. This was done to reduce the mount of drawings needed to describe the various Ferrocium Rod/Container (FR/C) mounts. Both items that are shown in the drawings are mounted to the same type mounts.

Figure 3:
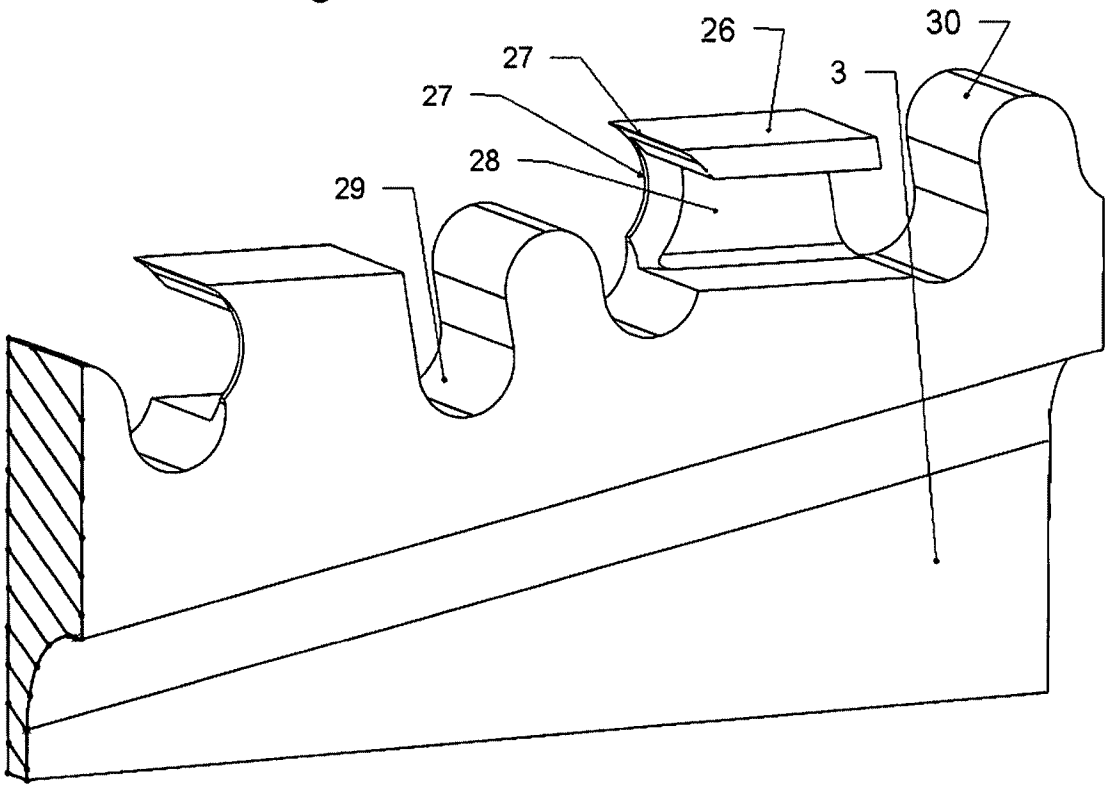
FIG. 3 is a left enlarged detail view of the multipurpose machete assembly's chisel tooth saw blade.

Located on the spine 62 of multipurpose machete is a saw section detail of the teeth which are depicted in FIG. 3. A relief angle 26 is located on the top of a typical tooth. Each tooth has a radius, or other shaped, cutting edge 27. In order to clear chips from the material being cut, groove 28 is provided. To allow the chips to clear from the tooth there is a relief groove 29. Kerf depth limiters 30 insure that the tooth does not get too much of a purchase in the material, and thus stalling the sawing motion, by limiting the depth that the tooth can cut. A relief cut, pan pocket 3, provides clearance to ensure less friction and binding of the blade.

Figure 4:
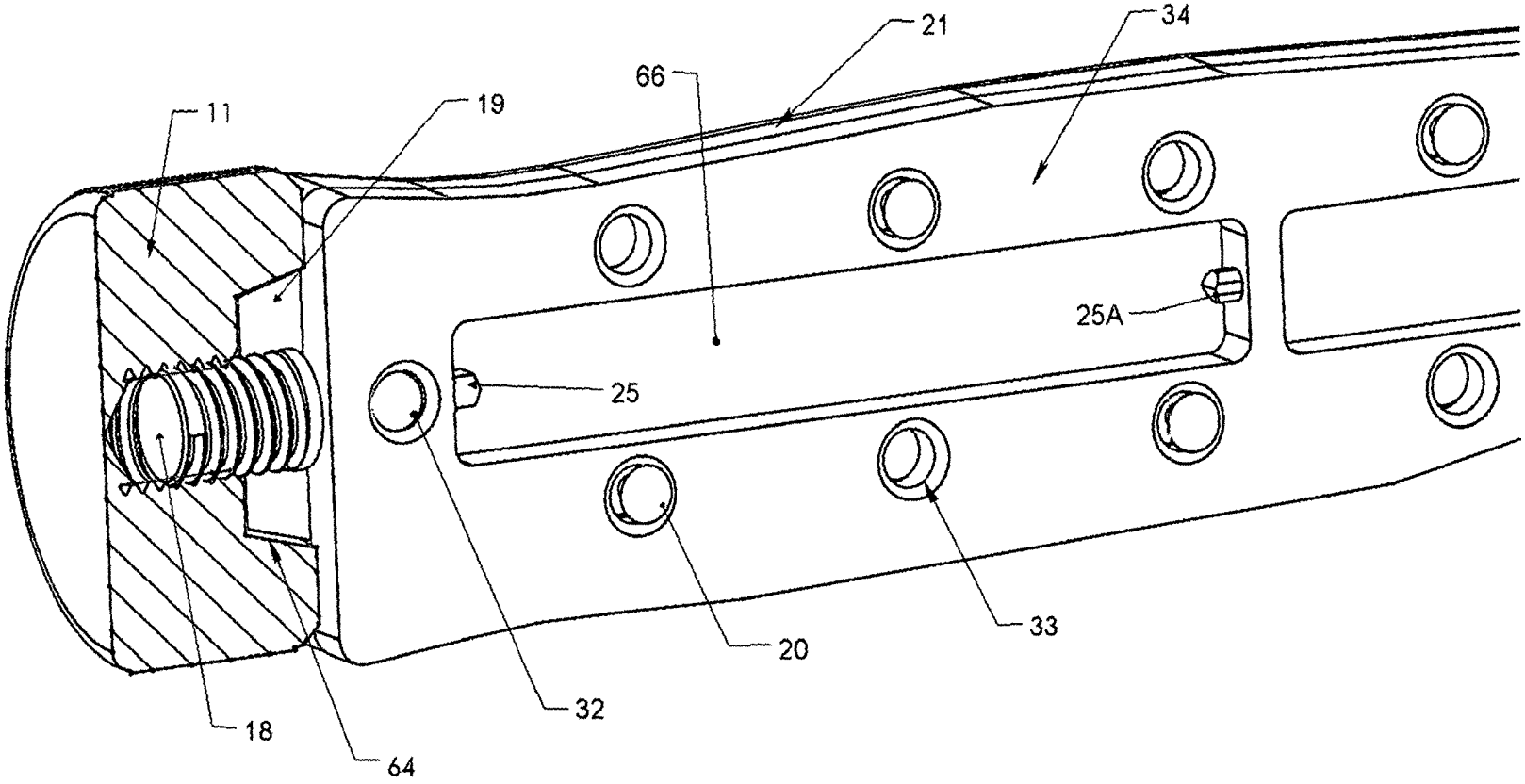
FIG. 4 is a right enlarged trimetric detail view with partial cross section of the multipurpose machete assembly's handle. Note the right grip/scale is removed and not shown to better show the inventions function.

The handle/scales are designed to be removed without tools. FIG. 4 depicts an enlarged detail view of this handle/scale area of the multipurpose machete with the right handle scale removed. Hammer/pommel/knob 11 can be unscrewed by hand from threaded stud 18, with clasp pin 32, then the force is released from integral taper on handle/scale 19 and thus allows clasp pins 20, installed in left handle/scale 21 to be able to release and be removed through the chamfered holes 33 in the multipurpose machete's blade handle 34. FIG. 4 also shows tapered female counter bore 64 of knob 11 which engages tapered parts 19 of the left 21 and right 22 handle scales. Also referring to FIG. 6, It is further noted that the integral handle part of the blade includes an aperture 66 which has a first end and an opposite second end. A first mount pin 25 is disposed at the first end of aperture 66, and a second mount pin 25A is disposed at the second end of aperture 66. Container 24 is shaped and dimensioned to removably connect to mount pins 25. A ferrocium rod 68 (shown in dashed lines) is shaped and dimensioned to fit in container 24. Jack screw 36 is connected to container 24. Jack screw 36 is connectable to first mount pin 25, and container 24 is connectable to second mount pin 25A.

Figure 5:
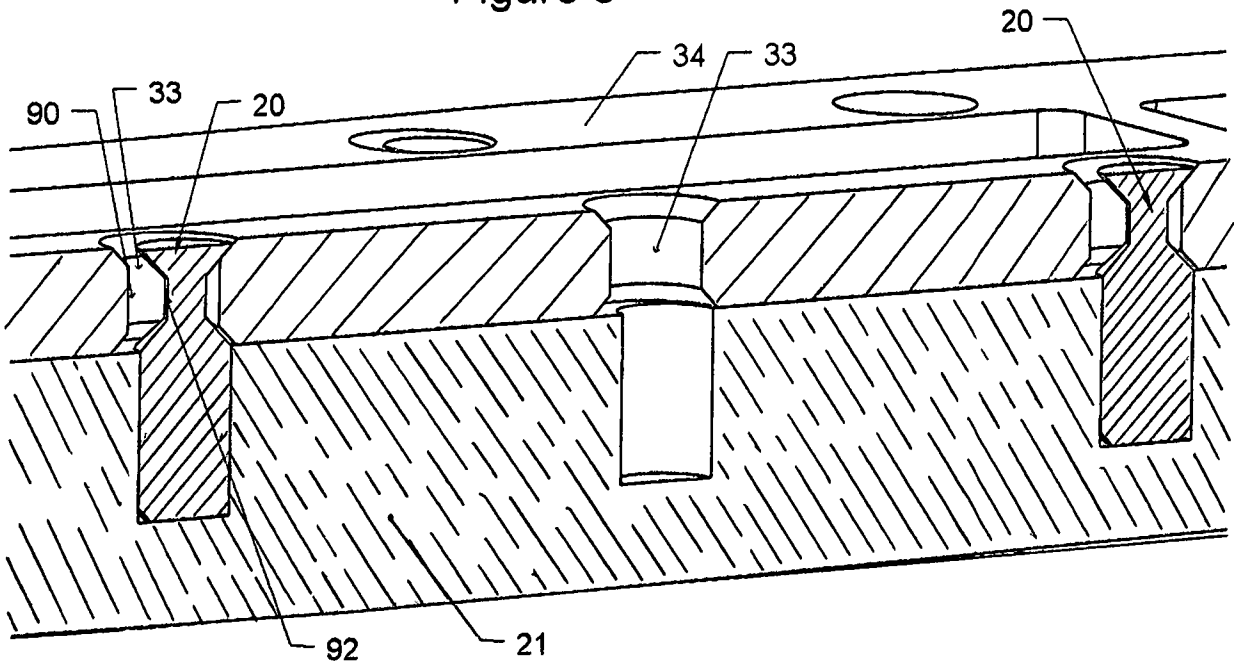
FIG. 5 is a top trimetric enlarged detail, cross sectional view of the multipurpose machete assembly's clasp pins.

FIG. 5 is an enlarged cross-section, detail view of the handle/scale 21, clasp pin 20, and blade interface. The clasp pin 20 when forced forward into chamfered hole 33, due to this wedge effect, holds the handle/scale on to the blades integral handle 34. It is noted that each chamfered hole 33 is formed by an edge 90 which has two chamfered areas. Clasp pins 20 each have a corresponding chamfered neck 92 which is shaped and dimensioned to receive the edge 90.

Figure 6:
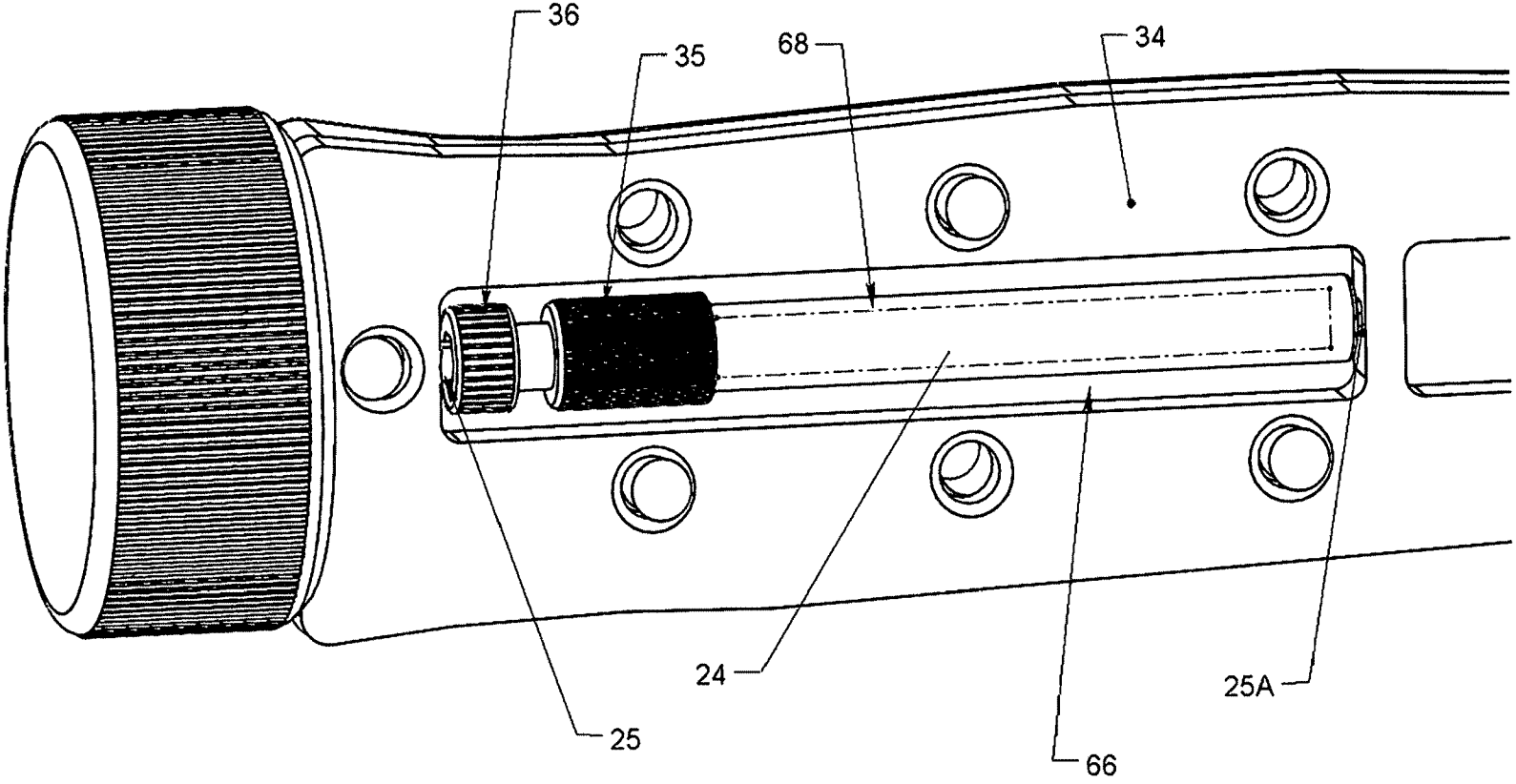
FIG. 6 is a right trimetric enlarged detail view, with the right scale/grip removed and not shown, of the preferred embodiment of the jack screw ferrocium rod/container mount.

To describe the ferrocium rod/container mount of the multi-purpose machete, FIG. 6 is an enlarged detailed view of the blade's handle with the right handle/scale removed. Ferrocium rod/container 24, and cap 35 are located between ferrocium/container pin mount 25, which are integral to blade handle 34. A jack screw 36, when un-screwed releases pressure on the mounting pins 25; from which are engaged into blind holes in each end of the ferrocium rod/container and jack screw 36.

Figure 7:
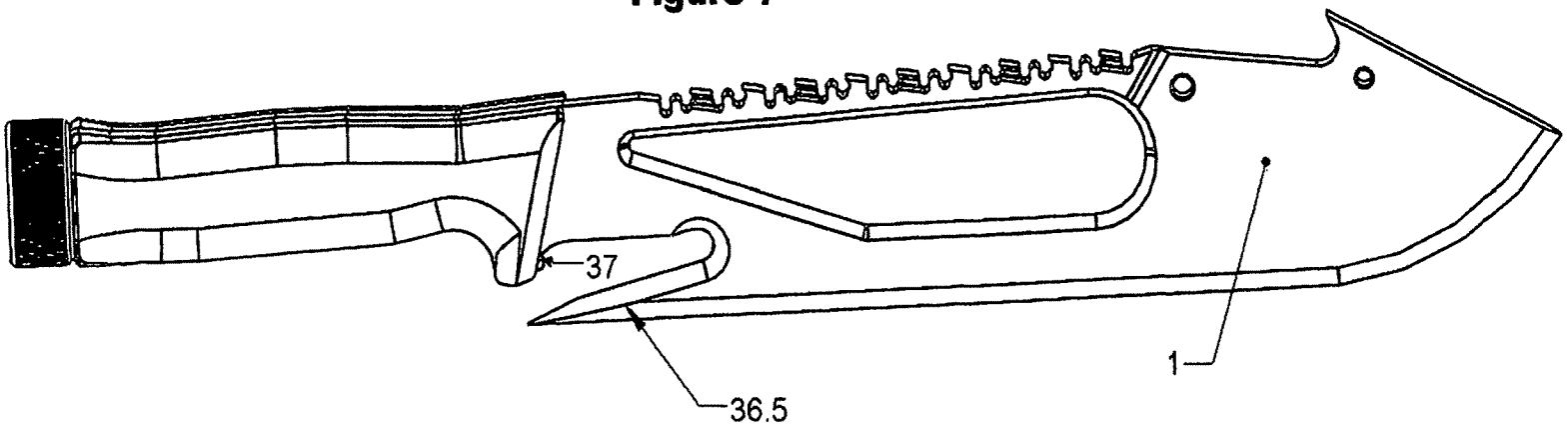
FIG. 7 is a right plan view of Embodiment 2 of the multipurpose machete assembly's reverse grip spur knife.

A side view of Embodiment 2 of the multi-purpose machete, FIG. 7, depicts this variant with spur knife 36.5 facing back toward the handle. When a reverse grip is assumed to use the spur knife 36.5 integrated into blade 1, then also the can opener feature with can lip stop 37 can be used in conjunction with the spur knife 36.5 to open cans.

Figure 8:
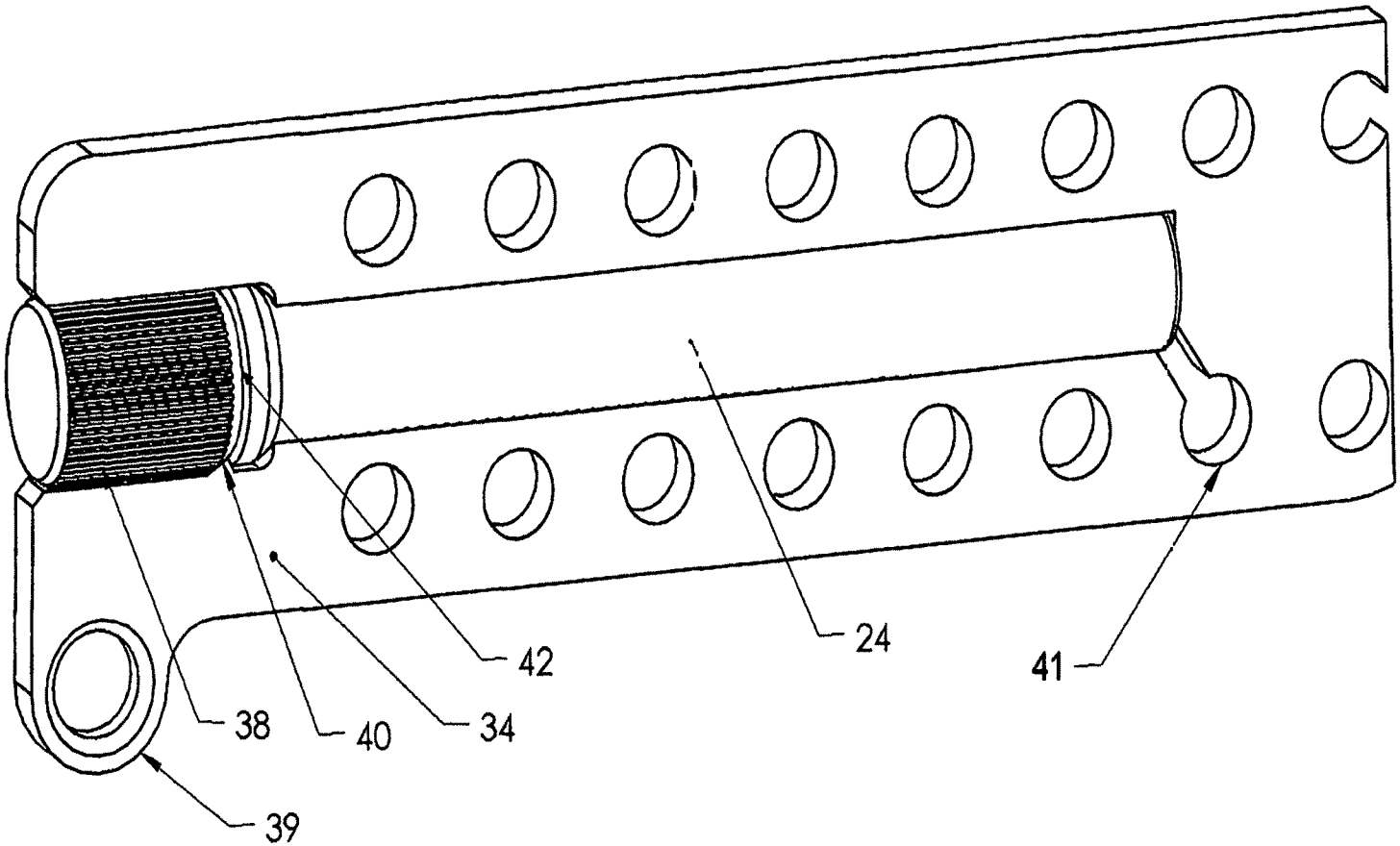
FIG. 8 is a right trimetric detail view of Embodiment 2, flex spring with catch, ferrocium rod/container mount.

Embodiment 3, FIG. 8, is an enlarged view of a variant of the multi-purpose machete's handle 34, integrated into the blade. Ferrocium rod/container 24 is held into place by a tapered tooth 40, integrated into the handle 34. FR/C cap 38, has a groove in it, 42, that locks into said tapered tooth 40. Lanyard hole boss/latch lever release 39, when pulled downward in relation to the drawing, the arm, 34 with the tapered tooth 40 on it, pivots on spring hinge 41 to release the FR/C from the handle.

Figure 9:
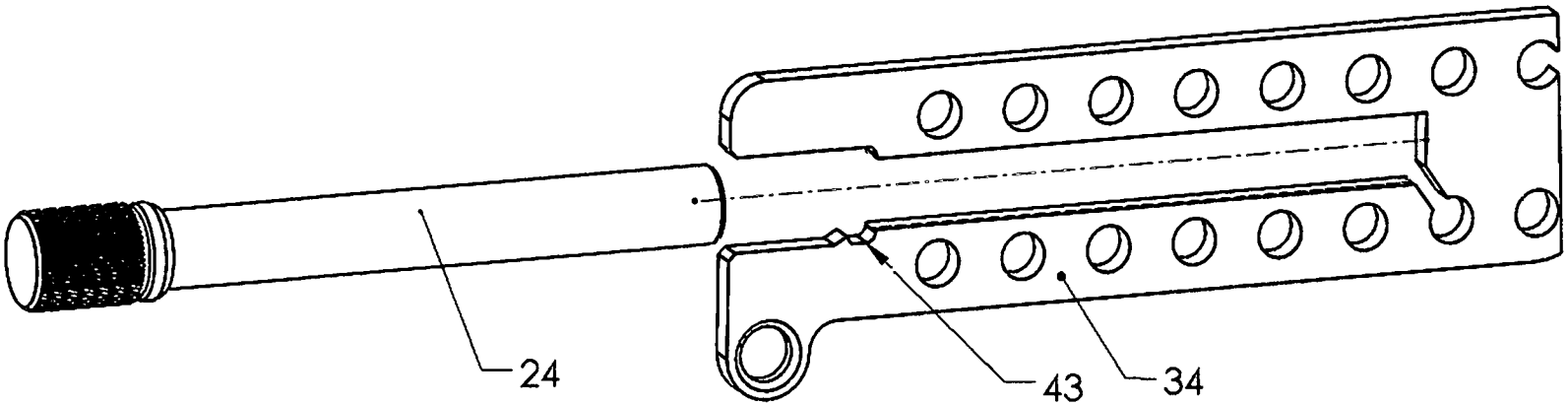
FIG. 9 is a right trimetric exploded view of Embodiment 2 flex spring with catch ferrocium rod/container mount.

FIG. 9 is an Exploded view of Embodiment 3. FR/C 24 is shown extracted from blade handle 34 revealing that the FR/C mount is formed on a circular fashion 43, to cradle the cylindrical FR/C.

Figure 10:
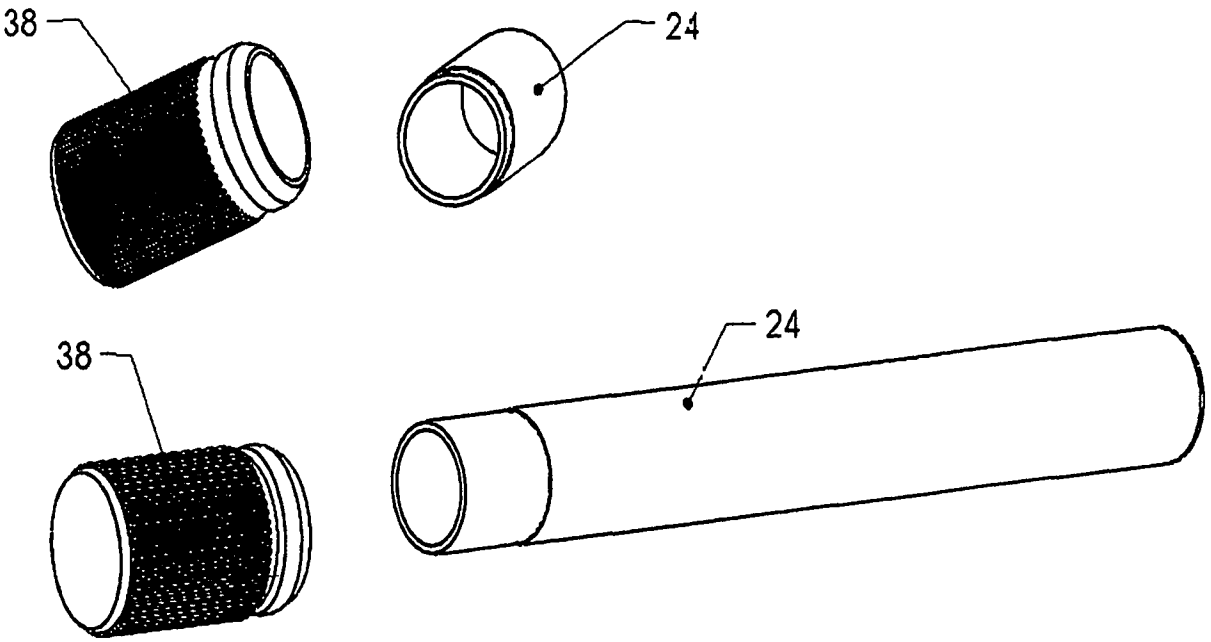
FIG. 10 is a trimetric exploded view of the ferrocium rod/container in Embodiment 2, the same ferrocium rod/cap and container is shown in both views.

To ease in the production of drawings to describe this invention, FIG. 10, provides two imagines of the same ferrocium rod/container in an enlarged exploded view of threaded container 24, which is shown with threaded container cap 38.

Figure 11:
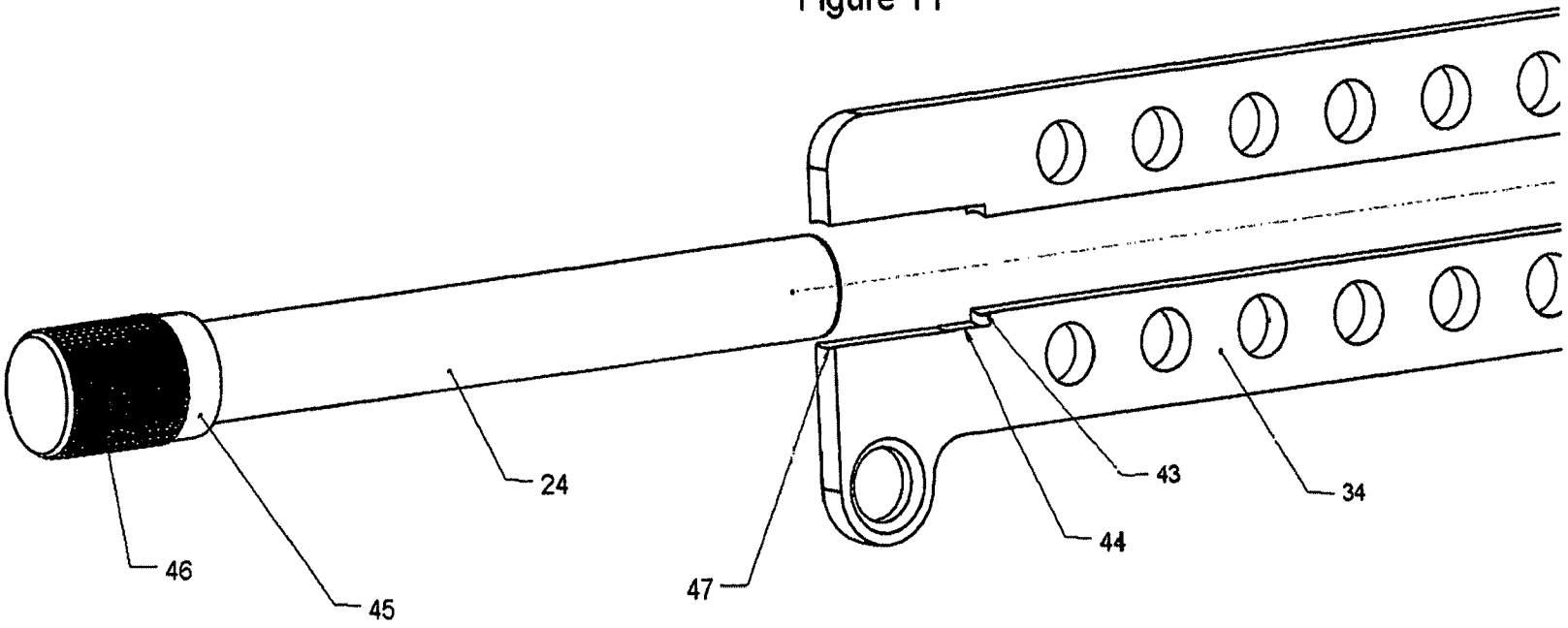
FIG. 11 is a right trimetric exploded detail view of Embodiment 3, a threaded blade handle with a corresponding threaded ferrocium/container cap.

Embodiment 4 of ferrocium rod/container blade handle, attachment is shown in FIG. 11. An exploded view depicts FR/C 24 removed from threaded handle mount 44 in blade handle 34. Corresponding threads 45 on FR/C cap 46. Cylindrical grooves 43 and 47 cradle FR/C 3 and container cap 46 when it is mounted in the blade handle and prevent it from slipping out the side of said blade handle 34.

Figure 12:
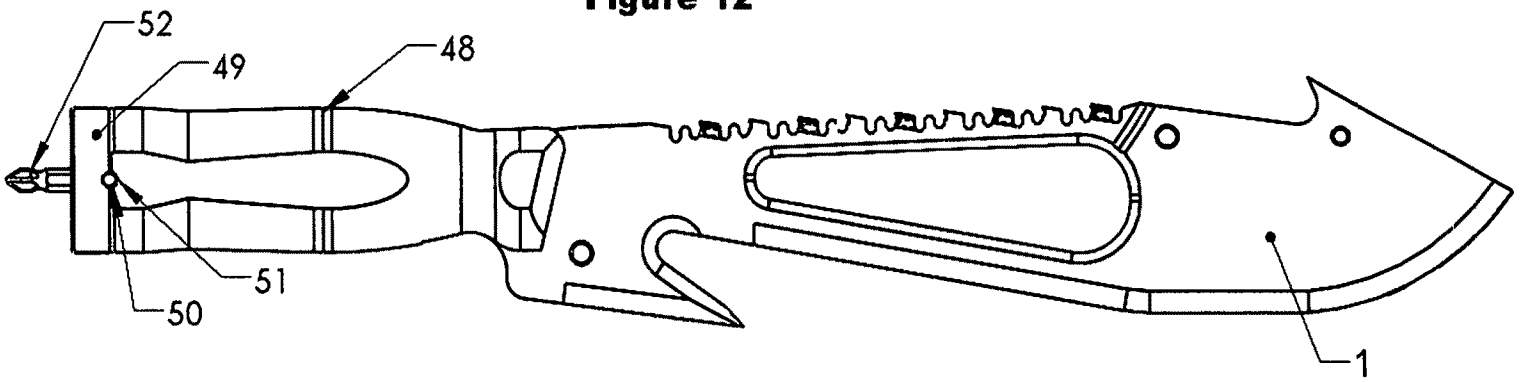
FIG. 12 is a right side view of Embodiment 4, a multipurpose machete with a hollow storage handle, and hammer/pommel/knob with an integral ¼" drive tool socket.

FIG. 12 illustrates a side view of embodiment 5 the multipurpose machete assembly with hollow handle 48 attached to blade 1. A hammer/pommel 49 is threaded into handle 48 and is locked into place when spring loaded detent/button 50 which engages a detent groove 51 in said handle. The threads are timed so that the detent/button engages the handle detent 51 when the hammer/pommel surface is just about completely tight on the handle's bearing surface opening. This allows said hammer/pommel to drive ¼" tools, eg. philips head screw driver 52, and screw in or unscrew fasteners, without the hammer/pommel unscrewing.

Figure 13:
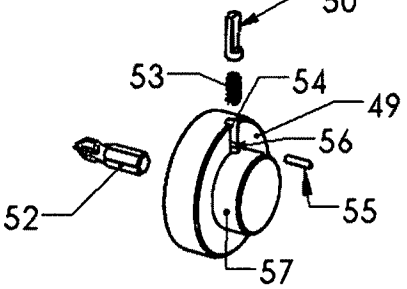
FIG. 13 is a exploded trimetric view of Embodiment 4, the hammer/pommel/knob of the multipurpose machete. This exploded view depicts the detent/button assembly; and, FIG. 14 is a trimetric partial exploded view of Embodiment 4, the hammer/pommel/knob and the handle of the multipurpose machete. This view depicts the detent/button assembled in the hammer/pommel/knob and illustrates the ¼" tool drive socket, and the threaded hollow handle.

FIG. 13 is an exploded view of the hammer/pommel 49, illustrating detent/button 50 which captures spring 53 in blind bore 54 and is held in place by roll pin 55 which is pressed into bore 56. Male threaded portion of the hammer/pommel is shown in 57.

Figure 14:
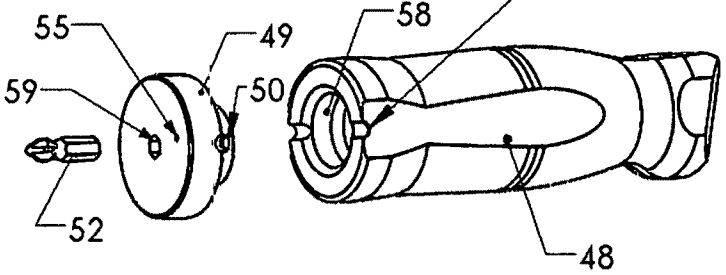

In FIG. 14 the partial exploded view depicts the handle 48 of the multipurpose machete, detached from blade for illustration purposes. This handle has a corresponding female thread 58 with detent groove 54 in hollow handle 48. Hammer/pommel assembly 49 with ¼" hex driver 59 and philips head screw driver bit 52, roll pin 55 holds in place detent/button 50.

The following paragraphs describe some of the features of the multipurpose machete:

A multipurpose machete assembly with a blade that has a many features integrated into it, including a spur knife. The main blade of the machete has a spur knife that protrudes near the handle and tapers to a sharp point. Said spur knife has one or more cutting edges and is in the general shape of a triangle, a trapezoid or a rectangle. Above this spur knife there is an open area to provide clearance. This clearance area, is generally an opening bigger that ½" (13 mm). Reference: this open area allows the cutting of items that could not be cut without this opening. The spur knife may be a separate blade attach to the handle or by some other means near the handle.

A multipurpose machete assembly with a blade that has many features integrated into it, including a chisel tooth saw blade. A chisel edge tooth is formed on a radiused or other shaped cutting edge on a rectangular or triangular or trapezoidal, or radius shaped tooth. This chisel tooth cutting edge is perpendicular to the multipurpose machete blade's cutting edge. Said tooth has relief angles on the sides of the tooth. The cutting edge is angled in reference to the cutting direction so that the chips of the material being cut are pushed away from the cutting edge while a sawing motion is maintained. A chip relief groove running parallel to the blade provides an area for the chips to pass through while the saw is in motion in the kerf. Said chips are then forced into a relief area after each tooth where the chips are free to fall from the saw tooth. In between each tooth is one or more kerf depth limiters. These kerf depth limiters, limit the depth and the amount of material that the chisel teeth are allowed to purchase, thereby ensuring efficient sawing motion without overloading and stopping the saw motion. Reference: this invention the chisel tooth saw, is unique to fixed tooth saws.

A multipurpose machete assembly with a blade that has a many features integrated into it, including easily removable handle scales. A round or other shaped knob/hammer/pommel with or without an outer traction, grip surface, and a tapered female counter bore, and an internal thread allows pressure to be applied to a external threaded stud, which is clasp pinned to blade's integral handle which in turn applies linear pressure to the male tapered handle end and thus forces tapered/chamfered clasp pins to engage corresponding tapered/chamfered holes in the handle that is an integral part of the blade. By tightening or removing the hammer/pommel/knob, this action allows the handle/scales to be easily removed or installed without tools.

A multipurpose machete assembly with a blade that has a many features integrated into it, including a integrated feature to mount a ferrocium rod or a container with cap (FR/C) inside of the handle. In one embodiment the FR/C is held in-between two integral mounting pins by a jack screw. Said screw is threaded into the cap of the FR/C, and when rotated in the appropriate direction forces counter bores on each side of the FR/C to engage concentrically with the mounting pins. The screw is turned until the FR/C is snug between the two integrated mounting pins, and vice versa to remove the FR/C from the handle. In another embodiment, (See Embodiment 2) the FR/C is held into the multi-purpose machete assembly blade with integral handle by a male threaded cap on the FR/C. This male threaded cap engages the female interrupted threads in the blades integral handle. In another embodiment, (See Embodiment 3) the FR/C is held into the multi-purpose machete assembly blade with integral handle by spring loaded male catch. Said male catch is integrated into the blades integral handle and the handle is designed so that one arm of the handle can be flexed out to disengage the male catch from the female groove in the cap of the FR/C. Thusly, the FR/C is removed from the handle. A round bore is featured in the blades integral handle to concentrically guide the FR/C snugly in the handle to help secure it and to align it with the catch.

A multipurpose machete assembly with a blade that has a many features integrated into it, including a large pocket formed into the blade. Large pocket also has a pour spout or groove formed into the blade. This pocket is intended to be used to hold soil when in use as a shovel and also can be used as an emergency pan to boil water, etc. This pocket has an integral pour spout. It is noted that the pour spout extends from the pan to the spine of the blade.

The hammer/pommel on embodiment 6 has an integral ¼" tool driver, tools are held in place with a magnetized hammer/pommel or a magnetic insert, or by mechanical means. To keep the hammer/pommel from unscrewing, a button/detent is provided and locks into the hollow handle on the multipurpose machete. This detent/button locking hammer/pommel is unique to the field of knives.

The invention claimed is:

1. A machete, comprising:

a handle having an end which has a center;

a blade connected to said handle, said blade having a tip, said blade having a proximal part which is disposed adjacent to said handle, and a spine;

a spur knife is disposed at said proximal part of said blade opposite said spine, said spur knife protrudes away from said handle and tapers to a sharp point, and said spur knife has a cutting edge;

a central axis extending through said center of said end of said handle to said tip of said blade;

said spur knife totally disposed on an opposite side of said central axis from said spine;

said handle including a removable left handle scale and a removable right handle scale, said removable left handle scale and said removable right handle scale forming a storage area therebetween;

said removable left handle scale and said removable right handle scale handle scale each including a plurality of clasp pins;

said blade including an integral handle part, said integral handle part including a plurality of chamfered holes which are shaped and dimensioned to engage said plurality of clasp pins, each said chamfered hole is formed by an edge which has two chamfered areas;

said clasp pins each having a corresponding chamfered neck which is shaped and dimensioned to receive said edge;

said removable left handle scale and said removable right handle scale each including a tapered part;

said handle including a knob which has a tapered female counter bore which is shaped and dimensioned to engage said tapered parts of said removable left handle scale and said removable right handle scale;

a threaded stud which is removably connected to said integral handle part of said blade; and, said knob shaped and dimensioned to threadably engage said threaded stud.

2. The machete according to claim 1, further including:

said blade including an integral handle part which includes an aperture having a first end and an opposite second end;

a first mount pin is disposed at said first end of said aperture, and a second mount pin is disposed at said second end of said aperture;

a container;

a jack screw which is connected to said container; and, said jack screw is connectable to said first mount pin, and said container is connectable to said second mount pin.

3. The machete according to claim 1, further including:

said blade including an integral handle part which includes an aperture having a first end and an opposite second end; and, a ferrocerium rod which is shaped and dimensioned to fit in said aperture.

4. The machete according to claim 1, further including:

a saw blade disposed on said spine of said blade, said saw blade including a plurality of spaced-apart teeth;

each said tooth having a cutting edge which is angled with respect to a cutting direction;

each said tooth including a chip relief groove; and, a plurality of kerf depth limiters are disposed between said teeth.

5. The machete according to claim 1, the machete cooperating with water, the machete further including said blade including a pan which is shaped and dimensioned to receive the water and a pour spout which communicates with said pan; and, said pour spout extending from said pan to said spine.

6. A machete, comprising:

a handle having an end which has a center;

a blade connected to said handle, said blade having a tip, said blade having a proximal part which is disposed adjacent to said handle, and a spine;

a spur knife is disposed at said proximal part of said blade opposite said spine, said spur knife protrudes away from said handle and tapers to a sharp point, and said spur knife has a cutting edge;

a central axis extending through said center of said end of said handle to said tip of said blade;

said spur knife totally disposed on an opposite side of said central axis from said spine;

said handle including a removable left handle scale and a removable right handle scale, said removable left handle scale and said removable right handle scale forming a storage area therebetween;

said removable left handle scale and said removable right handle scale each including a plurality of clasp pins;

said blade including an integral handle part, said integral handle part including a plurality of chamfered holes which are shaped and dimensioned to engage said plurality of clasp pins, each said chamfered hole is formed by an edge which has two chamfered areas;

said clasp pins each having a corresponding chamfered neck which is shaped and dimensioned to receive said edge;

said removable left handle scale and said removable right handle scale each including a tapered part;

said handle including a knob which has a tapered female counter bore which is shaped and dimensioned to engage said tapered parts of said removable left handle scale and said removable right handle scale;

a threaded stud which is removably connected to said integral handle part of said blade;

said knob shaped and dimensioned to threadably engage said threaded stud; and, said blade including a pan and a pour spout which communicates with said pan, said pour spout extending from said pan to said spine.

7. A machete, comprising:

a handle;

a blade connected to said handle, said blade having a proximal part which is disposed adjacent to said handle, and a spine;

said handle including a removable left handle scale and a removable right handle scale, said removable left handle scale and said removable right handle scale forming a storage area therebetween;

said removable left handle scale and said removable right handle scale each including a plurality of clasp pins;

said blade including an integral handle part, said integral handle part including a plurality of chamfered holes which are shaped and dimensioned to engage said plurality of clasp pins;

said removable left handle scale and said removable right handle scale each including a tapered part;

said handle including a knob which has a tapered female counter bore which is shaped and dimensioned to engage said tapered parts of said removable left handle scale and said removable right handle scale;

a threaded stud which is removably connected to said integral handle part of said blade; and, said knob shaped and dimensioned to threadably engage said threaded stud.

* * * * *